US010214975B2

(12) United States Patent
Holand et al.

(10) Patent No.: US 10,214,975 B2
(45) Date of Patent: Feb. 26, 2019

(54) VERTICAL PIPE HANDLING SYSTEM AND METHOD FOR ITS USE

(71) Applicant: Cameron International Corporation, Houston, TX (US)

(72) Inventors: Max Paul Holand, Kristiansand (NO); Kristian Tindvik, Kristiansand (NO); Kenneth Pedersen McCabe, Kristiansand (NO)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/498,555

(22) Filed: Apr. 27, 2017

(65) Prior Publication Data

US 2017/0314343 A1 Nov. 2, 2017

Related U.S. Application Data

(60) Provisional application No. 62/329,896, filed on Apr. 29, 2016.

(51) Int. Cl.
*E21B 19/14* (2006.01)
*E21B 19/16* (2006.01)

(52) U.S. Cl.
CPC ..... *E21B 19/14* (2013.01); *E21B 19/16* (2013.01)

(58) Field of Classification Search
CPC ..... E21B 19/14; E21B 19/002; E21B 19/06; E21B 19/16; B25J 5/04; B25J 15/0028
USPC ..... 175/52, 85; 212/230; 414/23, 561, 618, 414/728, 730, 741, 742, 744.3, 744.4, 414/744.6, 744.7, 744.8, 745.1, 745.5, 414/745.6, 749.1, 751.1, 753.1; 901/14, 901/18, 31
See application file for complete search history.

(56) References Cited

U.S. PATENT DOCUMENTS 3,262,593 A * 7/1966 Hainer ..... B25J 5/04 105/147
3,371,728 A * 3/1968 Curtis ..... E21B 19/002 175/85
3,633,767 A * 1/1972 Mitchell ..... E21B 19/14 414/22.68
3,895,677 A * 7/1975 Bokenkamp ..... E21B 19/002 166/359
3,929,235 A * 12/1975 Howard ..... E21B 19/06 114/264
3,981,369 A * 9/1976 Bokenkamp ..... E21B 19/002 166/352

(Continued)

*Primary Examiner* — Gregory W Adams
(74) *Attorney, Agent, or Firm* — Helene Raybaud

(57) ABSTRACT

Systems and methods for vertical pipe handling include telescopic arm structures that move between retracted and extended positions in a horizontal plane, a cross arm structure connected to each telescopic arm structure, and a gripper head connected to the cross arm structure. The gripper head may be positioned at a desired location to receive, grip, position, and release a vertically oriented drill pipe or other tubular, and may include jaws that can be positioned to accommodate different sizes of drill pipe or tubulars. Means for raising and lower the gripper head, extending or retracting the gripper head in a horizontal plane, and tilting or pivoting the gripper head may also be provided. The vertical pipe handler may be housed below the drill floor and attached to the drill floor support structure.

18 Claims, 9 Drawing Sheets

(56) References Cited

U.S. PATENT DOCUMENTS

| | | | | | |
|---|---|---|---|---|---|
| 4,013,178 | A * | 3/1977 | Brown | E21B 19/07 | 294/102.2 |
| 4,196,049 | A * | 4/1980 | Burns | G21C 17/01 | 376/249 |
| 4,666,357 | A * | 5/1987 | Babbi | B66C 13/02 | 212/230 |
| 4,702,663 | A * | 10/1987 | Mischke | B25J 5/04 | 414/618 |
| 4,715,761 | A * | 12/1987 | Berry | E21B 19/14 | 104/35 |
| 4,763,800 | A * | 8/1988 | Engler | B66F 7/20 | 212/195 |
| 5,351,767 | A * | 10/1994 | Stogner | E21B 19/16 | 175/162 |
| 5,609,457 | A * | 3/1997 | Burns | E21B 19/24 | 175/85 |
| 7,228,919 | B2 * | 6/2007 | Fehres | E21B 19/155 | 166/380 |
| 2013/0136571 | A1 * | 5/2013 | Weiss | B25J 9/106 | 414/751.1 |
| 2013/0302114 | A1 * | 11/2013 | Reddy | E21B 3/02 | 414/22.55 |

* cited by examiner

VERTICAL PIPE HANDLING SYSTEM AND METHOD FOR ITS USE

CROSS-REFERENCE TO PENDING APPLICATIONS

This application claims priority to U.S. Provisional Patent Application No. 62/329,896 filed Apr. 29, 2016.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

This disclosure relates to pipe handling systems and methods and, in particular, to vertical pipe handling systems and methods used on various drilling rigs, including but not limited to jackup rigs, semisubmersible rigs, drillships, and land rigs, to perform vertical pipe handling operations on the drill floor.

Typical wells are drilled using a drill bit that is coupled to a rotating drill string composed of joints or sections of drill pipe. As the well depth increases, the drill string is lengthened by adding more joints or sections of drill pipe, which are threaded or otherwise coupled to one other. Various pipe handling components and features are used to manage the drill string and drill pipe on the drill floor. For example, vertical pipe handling typically involves use of a mousehole. The mousehole is a vertically oriented sleeve or tube that holds the next joint or section of drill pipe to be added to the drill string. The mousehole hangs down from the deck frame and into the space between the drill floor and the cellar deck. The mousehole typically includes an elevating bottom, called a rabbit, that can move up and down with the tube.

As the drill bit drills down farther into the well and the kelly (i.e., the uppermost part of the drill string) is near the rotary table, the kelly is screwed onto the next joint of drill pipe being held by the mousehole. The combined kelly and drill pipe are then raised up to remove the drill pipe from the mousehole and the removed drill pipe is screwed onto the rest of the drill string. The drill string is then lowered, rotated, and pumped through to continue drilling, and another joint of drill pipe is put in the mousehole to await the next connection. This process is repeated until the maximum desired depth of the well is reached.

Space on the drill floor and around the drilling rig where the mousehole is located is limited. Mouseholes also involve multiple components spread between the drill floor and the cellar deck so can be difficult or time-consuming to construct, maintain, and repair. Finally, because each mousehole is in a fixed position, it blocks the movement of cranes and other equipment around the drilling rig.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

An embodiment of a vertical pipe handling system includes a vertical pipe handler housed between a drill floor and a drill floor support structure. The vertical pipe handler has a pair of telescopic arm structures that move between retracted and extended positions in a horizontal plane, a cross arm structure connected to the forward end of each telescopic arm structure, and a gripper head connected to the cross arm structure. The gripper head may be positioned at a desired location to receive, grip, position, and release a vertically oriented drill pipe or other tubular. The gripper head may also permit the drill pipe or tubular to slide up or down relative to the gripper head while being engaged by the gripper head.

Embodiments of the gripper head may also include a set of jaws that can be positioned to accommodate different sizes of drill pipe or tubulars in order to receive, grip, position, and release the different size. The jaws of the gripper head may be manually or automatically adjusted to hold or release the tubular. The gripper head may be raised and lowered by a dampening/positioning device connected to the gripper head and the cross arm structure, while a hinge or other mechanism may be used to tilt or pivot the gripper head between various operational and parked configurations. A slider unit connected to the dampening/positioning device and the gripper head may be used to move the gripper head between retracted and extended positions in a horizontal plane. The vertical pipe handler may be housed between the drill floor and the structure that supports the drill floor.

An embodiment of a method of vertical pipe handling includes use of a vertical pipe handler that is located below the drill floor and connected to the structure that supports the drill floor. The method also includes actuating the gripper head that is connected to the cross arm structure of the vertical pipe handler to hold a vertically oriented drill pipe or other tubular, including a stand of two or more tubulars, and actuating the telescopic arm structures that are connected to the cross arm structure to move the stand between two horizontal positions.

Embodiments of the vertical pipe handling system and method may be configured to hold the weight of a drill stand during stand building and to guide the drill stand among various stand-handling positions while minimizing the amount of space occupied on the drill floor. The embodiments may be simpler and less expensive to construct, maintain, and repair than those of the prior art and can be positioned to avoid interference with the movement of cranes and other equipment around the drilling rig.

BRIEF DESCRIPTION OF THE DRAWINGS

The subject disclosure is further described in the following detailed description, and the accompanying drawing and schematic of non-limiting embodiment of the subject disclosure. The features depicted in the figure are not necessarily shown to scale. Certain features of the embodiments may be shown exaggerated in scale or in somewhat schematic form, and some details of elements may not be shown in the interest of clarity and conciseness.

Figure 1:
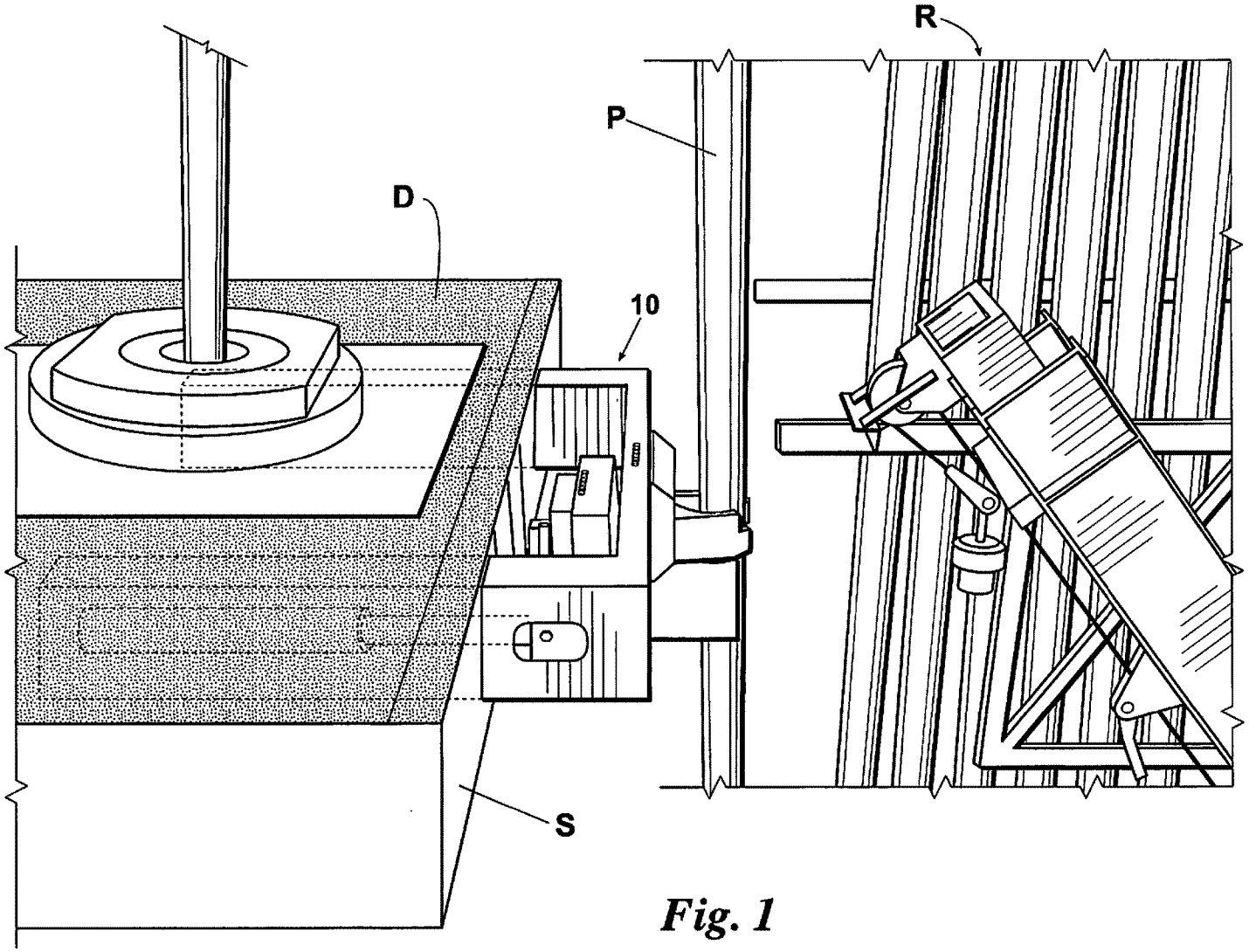
FIG. 1 is an isometric view of an embodiment of a vertical pipe handling system, shown in use to hold a section of drill pipe.

ELEMENT NUMBERS AND ELEMENTS USED IN THE DRAWING FIGURES AND DETAILED DESCRIPTION

10 Vertical pipe handling system
15 Vertical pipe handler
20 Gripper head
21 Jaws
30 Telescopic arm structure
35 Hydraulic cylinder
37 Forward end
40 Cross arm structure
50 Load sensing device
55 Load cell
60 Tilt or pivot means
65 Hinge
70 Dampening/positioning device
75 Linear actuation mechanism
80 Slider unit
D Drill floor
S Drill floor support structure
R Pipe rack
P Drill pipe

DETAILED DESCRIPTION

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As shown in FIG. 1, an embodiment of the vertical pipe handling system 10 may be positioned in the open space between the drill floor D and the pipe rack R to facilitate the transfer of drill pipe P from a pipe rack R to the vertical pipe handling system 10 and from the vertical pipe handling system 10 to a drill stand or pipe rack. In addition, the vertical pipe handling system 10 may be mounted in the setback area of the drill floor D, thereby reducing the amount and size of pipe handling equipment that is conventionally located in the limited space of the setback area. The vertical pipe handling system 10 may be vertically positioned below the drill floor D and connected to a structure S supporting the drill floor, as shown in FIG. 1, or at any level that is suitable for guiding a drill pipe, casing, collar, or tubular and holding load and capable of supporting the system. For example, the pipe vertical handling system 10 may be mounted onto one or more beams immediately beneath the drill floor D.

Figure 2:
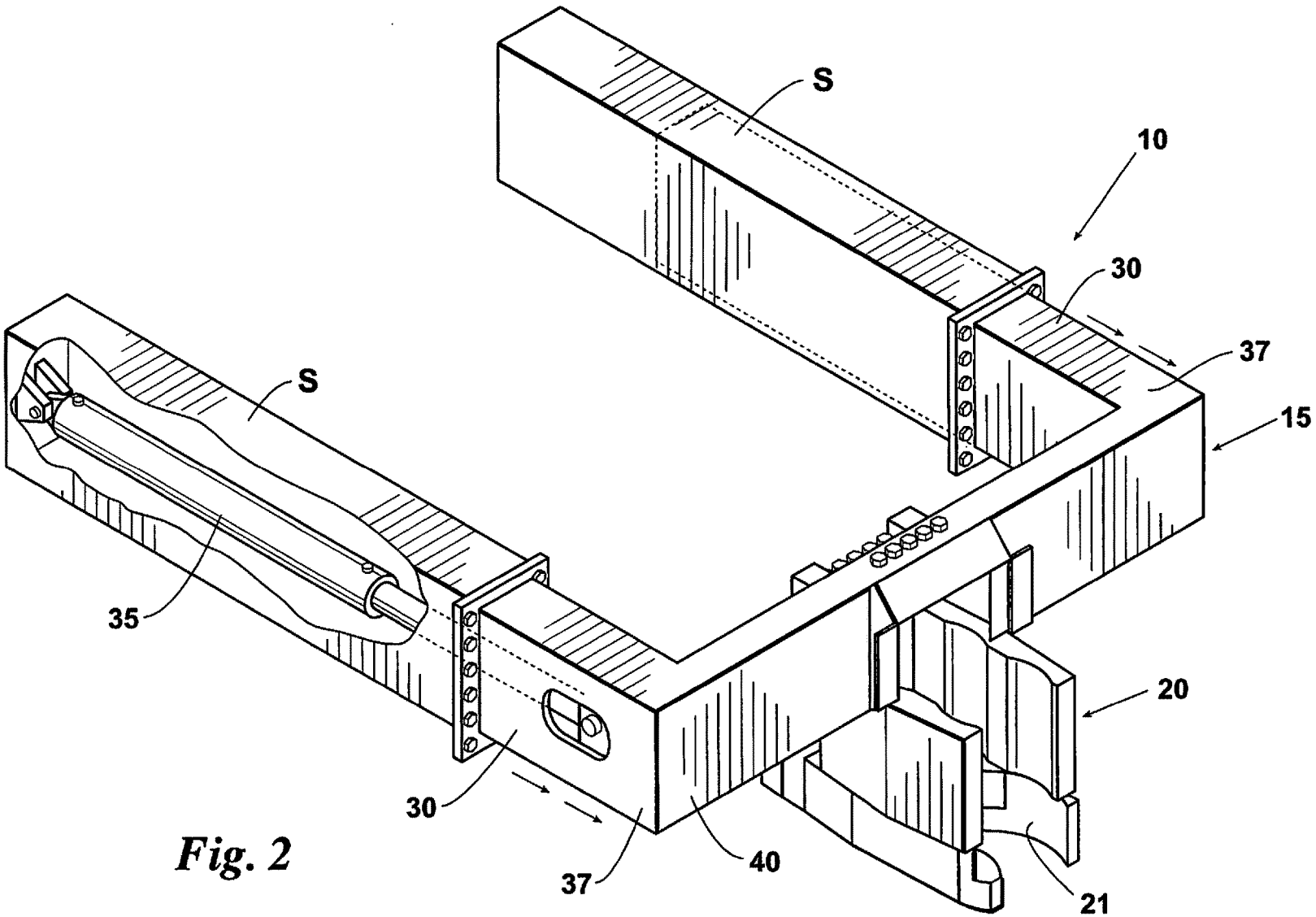
FIG. 2 is an isometric view of an embodiment of a vertical pipe handler, including the gripper head, jaws, telescopic arm structures, cross arm structure, and hydraulic cylinder, shown in the extended position.
Figure 3:
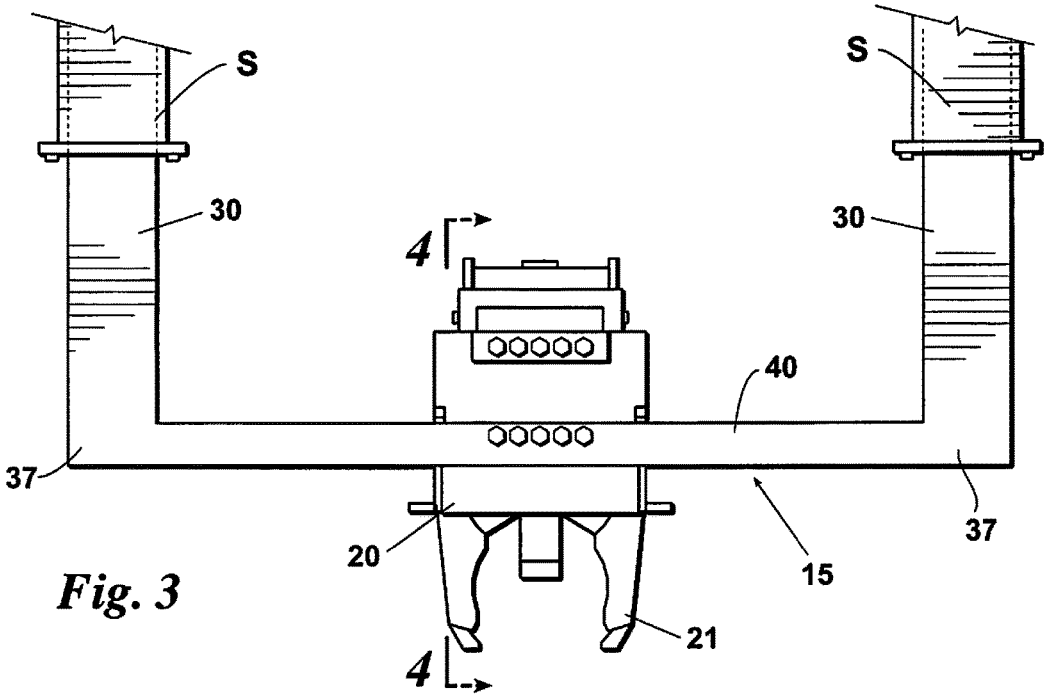
FIG. 3 is a top plan view of the embodiment of FIG. 2.
Figure 4:
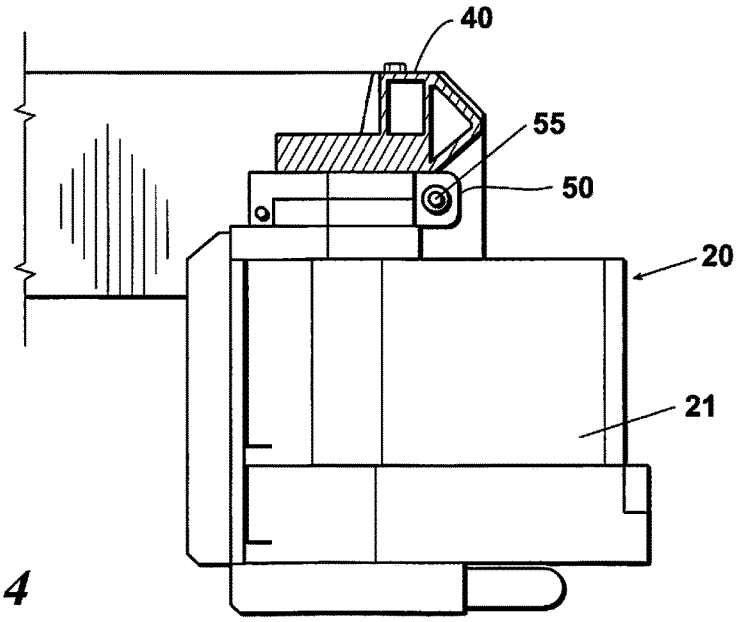
FIG. 4 is a cross-section view of the embodiment of FIG. 3, shown along the line 4-4.
Figure 5:
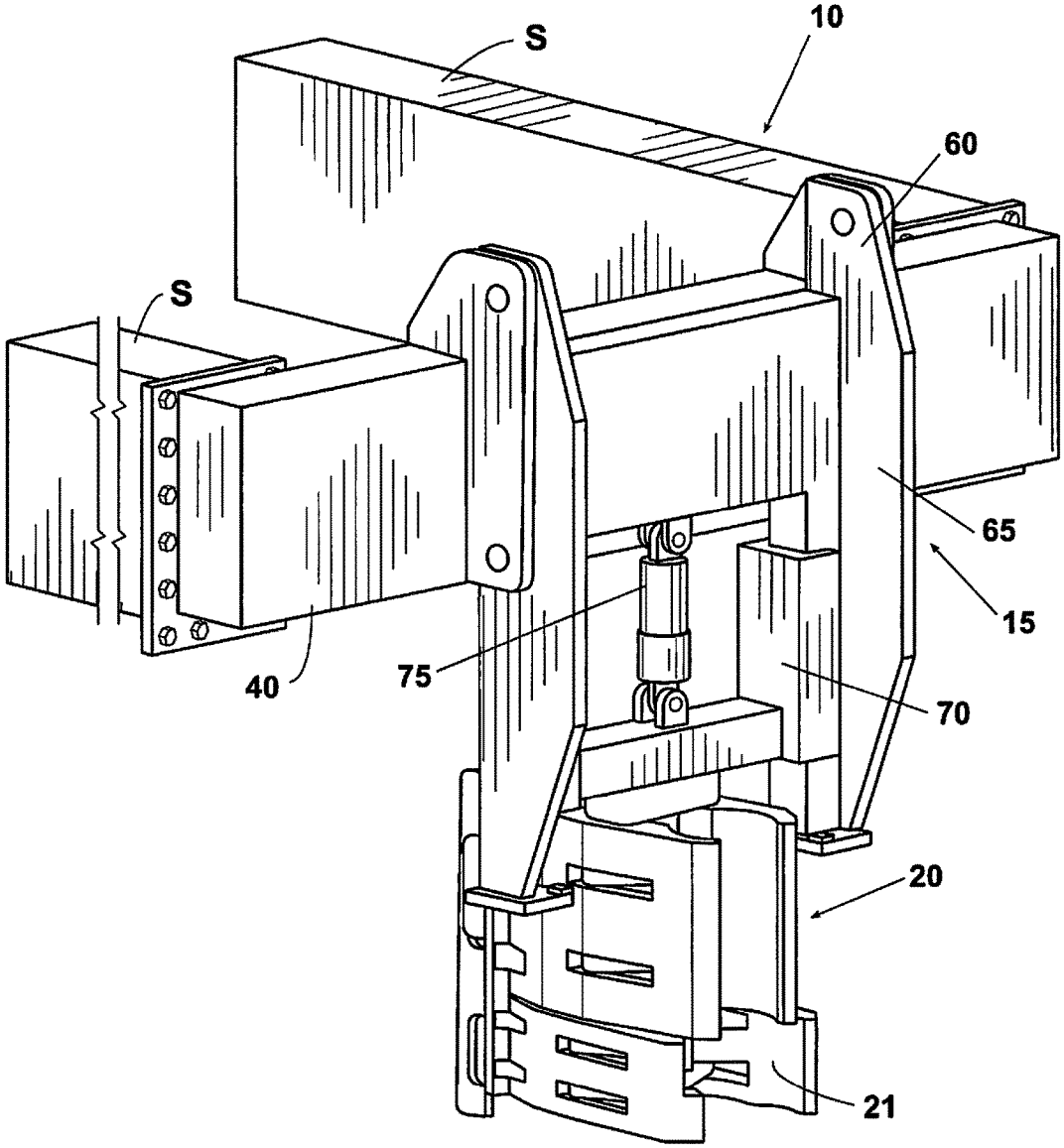
FIG. 5 is an isometric view of an embodiment of a vertical pipe handler, including the gripper head, jaws, telescopic arm structures, cross arm structure, dampening/positioning device, and tilt or pivot means, shown with both the telescopic arm structures and the dampening/positioning device in the retracted position.
Figure 6:
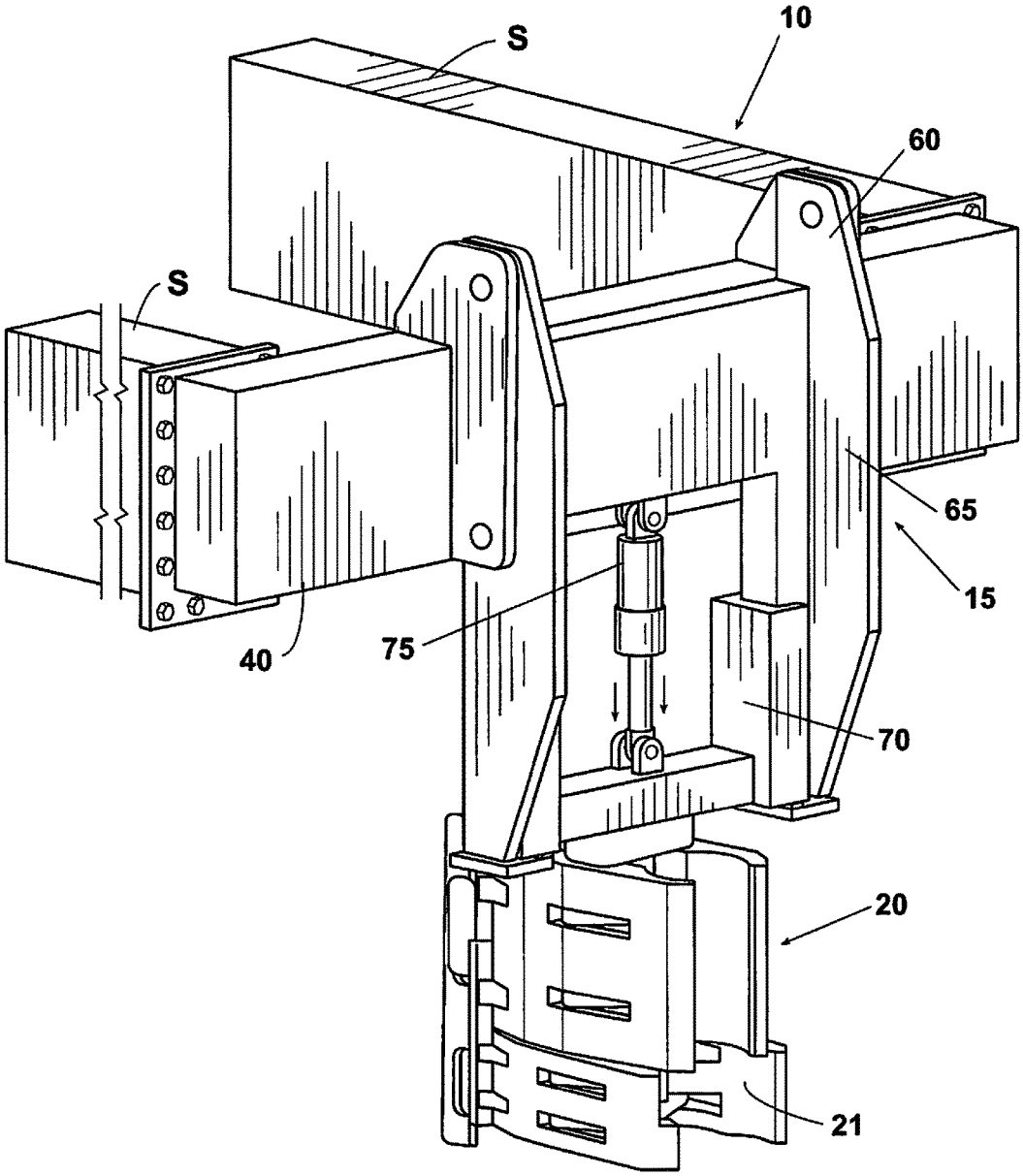
FIG. 6 is an isometric view of the embodiment of FIG. 5, shown with the telescopic arm structures in the retracted position and the dampening/positioning device in the extended position.
Figure 7:
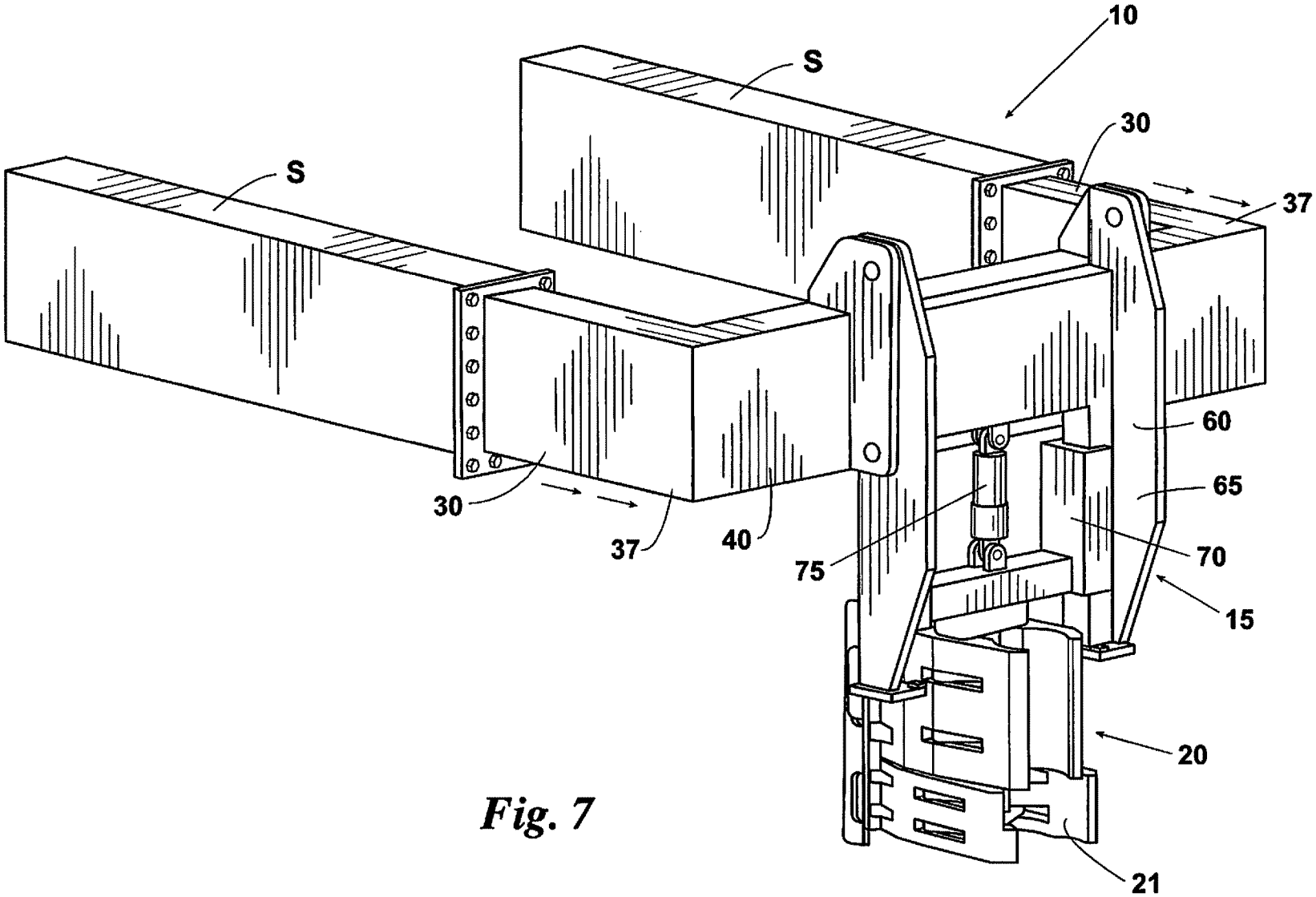
FIG. 7 is an isometric view of the embodiment of FIG. 5, shown with the telescopic arm structures in the extended position and the dampening/positioning device in the retracted position.
Figure 8:
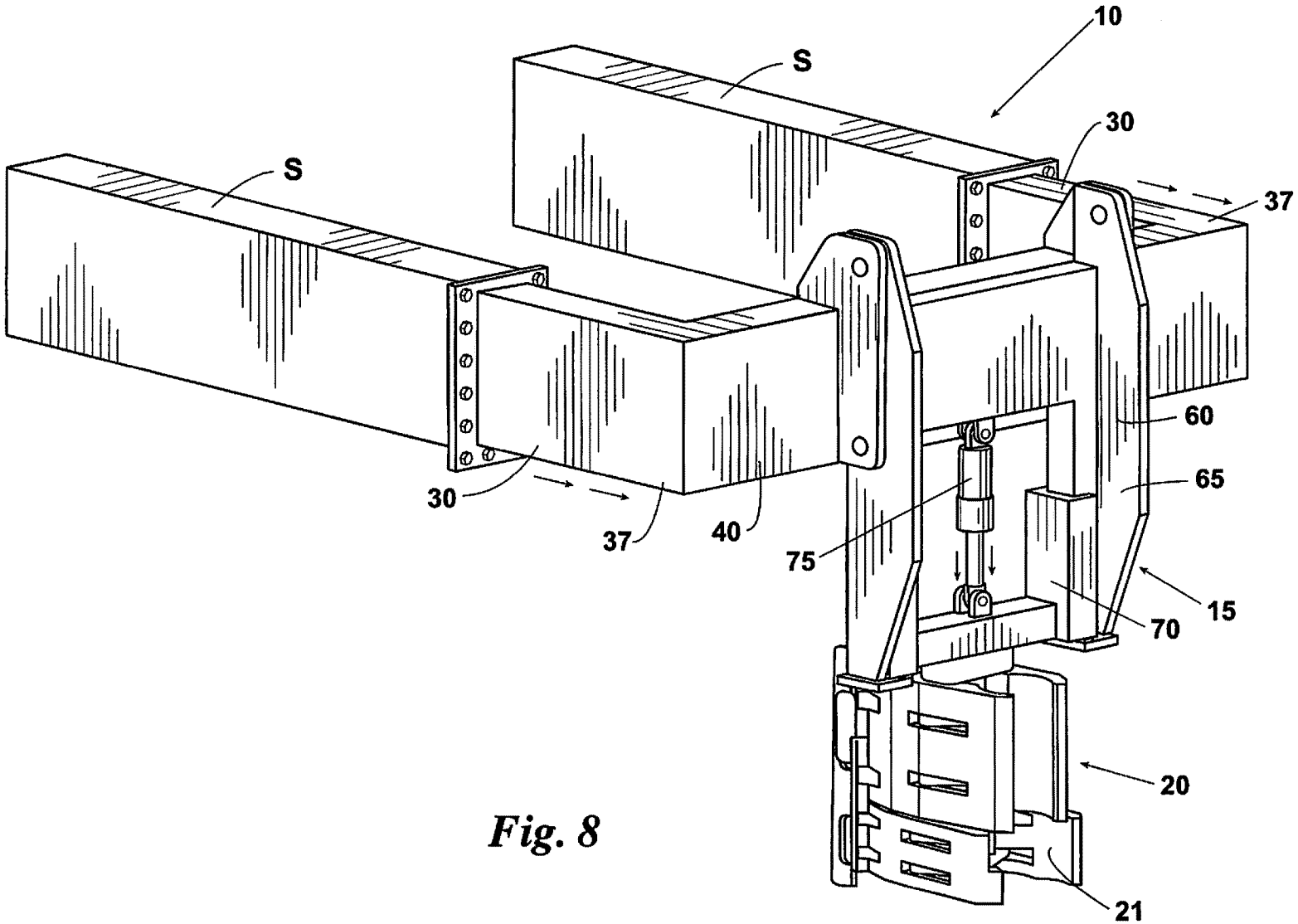
FIG. 8 is an isometric view of the embodiment of FIG. 5, shown with both the telescopic arm structures and the dampening/positioning device in the extended position.
Figure 9:
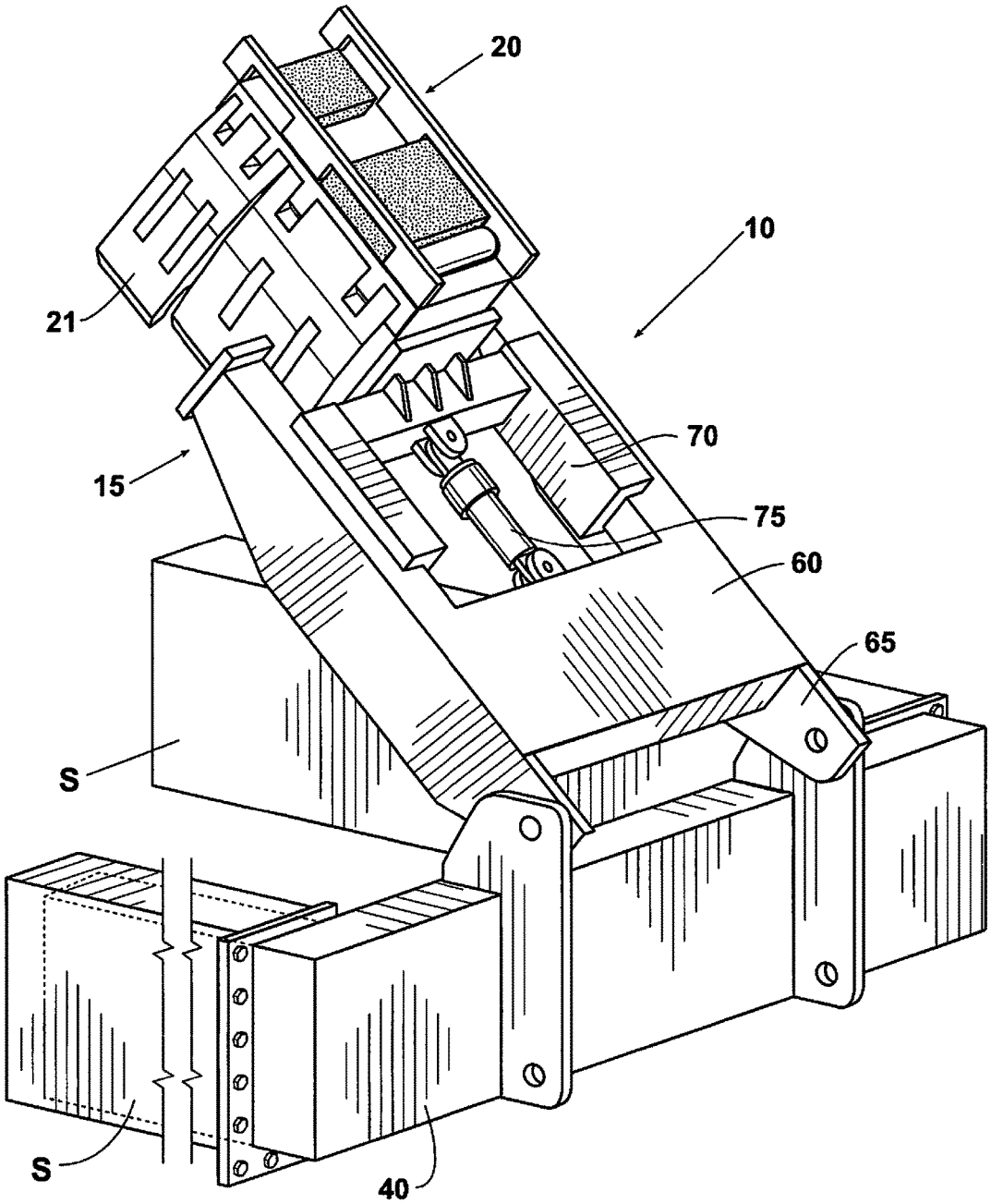
FIG. 9 is an isometric view of an embodiment of FIG. 5, shown in a parked or transport position.

Referring to FIGS. 2-4, an embodiment of a vertical pipe handling system 10 includes a vertical pipe handler 15. The vertical pipe handler 15 includes a gripper head 20 with at least one set of jaws 21 that may be automatically or manually positioned to hold, release, or otherwise accommodate various types and sizes of tubulars without removing or replacing the gripper head 20. The gripper head 20 is connected to a cross arm structure 40. Each end of the cross arm structure 40 is connected to a forward end 37 of a telescopic arm structure 30, and the telescopic arm structures 30 may be grouped in pairs.

Each telescopic arm structure 30 may move between a retracted position, an extended position, and intermediate positions between the two. In the retracted position, the distance between the cross arm structure 40 and the structure, such as the drill floor support structure S, to which the vertical pipe handler 15 is mounted is minimized. In the extended position, the majority of the telescopic arm structure 30 is exposed, and the distance between the cross arm structure 40 and the drill floor support structure S is maximized. The telescopic arm structure 30 of the embodiment may be actuated by a hydraulic cylinder 35 or its equivalent, but other actuation mechanisms, including but not limited to electric motors or electro-hydraulic systems, may also be used.

As shown in FIG. 3 and FIG. 4, the vertical pipe handler 15 may also include a load sensing device 50 to measure the weight of the tubular or the drill string. The load sensing device 50 may be a load cell 55 or its equivalent.

The telescopic arm structures 30 position the gripper head 20 toward or away from the drill floor support structure S it is mounted within to engage, guide, or disengage a tubular. In operation, the gripper head 20, which is configured to engage and interact with various joints or sections of drill pipe and drill string, facilitates positional manipulation and support of the drill pipe and drill string. That is, it can both guide and support a stand of drill pipe, drilling casing, or collars. Moreover, the gripper head 20 may be employed in place of a mousehole—and, thus, save space—by supporting a section of drill pipe while the vertical pipe handling equipment places a second section of drill pipe onto the first section for assembly, as is done in stand building. The gripper head 20, unlike a traditional mousehole, can serve to both support and manipulate the drill pipe, freeing up the vertical pipe handling equipment, for instance. In addition, the gripper head 20 can both support and manipulate piping, thereby reducing the number of handovers with respect to the drill stand.

Referring now to FIGS. 5 to 9, an embodiment of a vertical pipe handler 15 includes a gripper head 20 with jaws 21, a cross arm structure 40, and a pair of telescopic arm structures 30. The embodiment also includes a dampening/positioning device 70 that is between and connected to the cross arm structure 40 and the gripper head 20. The dampening/positioning device 70 may be used to raise and lower the gripper head 20 between a retracted position (in which the distance between the cross arm structure 40 and the gripper head 20 is minimized) and an extended position (in which the distance between the cross arm structure 40 and the gripper head 20 is maximized), or any intermediate position between the two. The dampening/positioning device 70 may be actuated by a linear actuation mechanism, including but not limited to a hydraulic stabbing cylinder.

The dampening/position device 70 may facilitate the adjustment of the "stick up" height of the drill pipe in the gripper head 20 with respect to the drill floor D. As an example, the dampening/positioning device 70 can be used to raise or lower the drill pipe held in the jaws 21 of the gripper head 20 in order to accommodate mating of the held drill pipe with the next section of drill pipe. The telescopic arm structures 30 and the dampening/positioning device 70 allow the vertical pipe handler 15 to accommodate various combinations of positions, including but not limited to retraction of both the telescopic arm structures 30 and the dampening/positioning device 70 (see FIG. 5), retraction of the telescopic arm structures 30 with extension of the dampening/positioning device 70 (see FIG. 6), extension of the telescopic arm structures 30 with retraction of the dampening/positioning device 70 (see FIG. 7), and extension of both the telescopic arm structures 30 and the dampening/positioning device 70 (see FIG. 8).

An embodiment of the vertical pipe handler 15 may include means 60 for tilting or pivoting the gripper head 20 through a predetermined angular range of motion. For example, as shown in FIGS. 5 to 9, the gripper head 20 may be mounted to a hinge 65 or equivalent mechanism. The hinge 65 is also mounted to the cross arm structure 40, and allows the gripper head 20 to be moved between operational (e.g., FIG. 5), parked (see FIG. 9), or other configurations. The parked configuration reduces the footprint of the vertical pipe handler 15, providing space for other operations, such as but not limited to crane operations, when the gripper head 20 is not in use. The gripper head 20 may also include means to facilitate linear and/or rotational movement of the gripper head 20.

Figure 11:
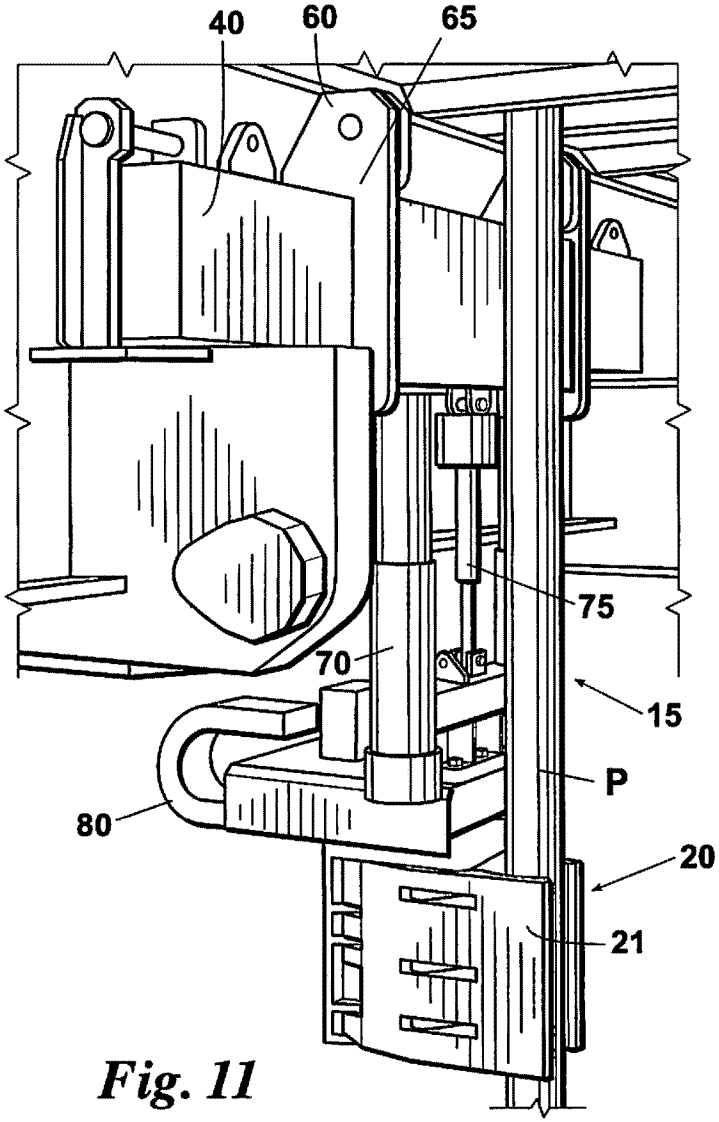
FIG. 11 is an isometric view of an embodiment of FIG. 5, shown with the slider unit of the gripper head in the extended position and the jaws of the gripper head holding a drill pipe.
Figure 10:
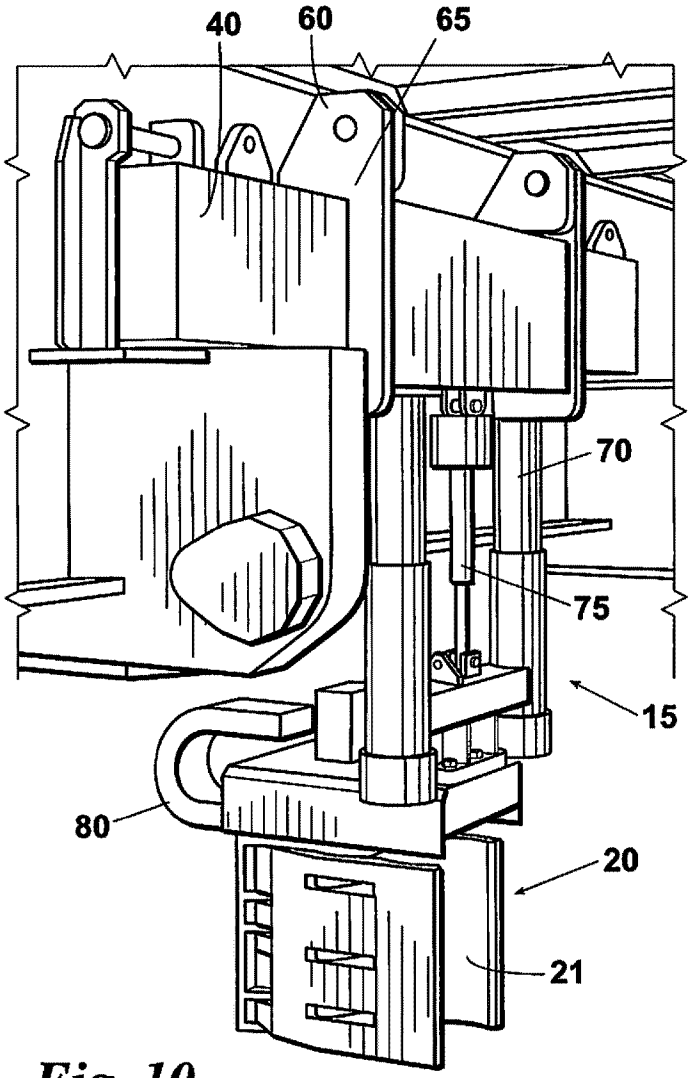
FIG. 10 is an isometric view of an embodiment of FIG. 5, shown with the slider unit of the gripper head in the retracted position.

Referring to FIG. 10 and FIG. 11, an embodiment of the vertical pipe handler 15 may include a slider unit 80, with the upper portion of the slider unit 80 connected to the lower end of the dampening/positioning device 70 and the lower portion of the slider unit 80 connected to the upper end of the gripper head 20. The slider unit 80 may move the gripper head 20 to a retracted position, an extended position, or intermediate positions between the two. In the retracted position, shown in FIG. 10, the edges of the jaws 21 that grip the drill pipe P or other tubular are approximately even with and in the same vertical plane as the dampening/positioning device 70. In the extended position, shown in FIG. 11, the jaws 21 extend forward of the dampening/positioning device 70 and are capable of engaging and holding drill pipe P. Using the slider unit 80 to retract the gripper head 20 prevents the gripper head 20 from interfering with the vertical passage of the tool joint.

An embodiment of a method for using the vertical pipe handling system 10 includes actuating the gripper head 20 that is connected to the cross arm structure 40 of the vertical pipe handler 15 to hold a vertically oriented stand of two or more tubulars. The method also includes actuating a pair of telescopic arm structures 30 that are connected to the cross arm structure 40 to move the stand between two horizontal positions. The jaws 21 of the gripper head 20 may be manually or automatically adjusted to hold or release the tubular. In addition, the gripper head 20 may be raised or lowered using a dampening/positioning device 70 connected to the cross arm structure 40 and the gripper head 20, horizontally retracted or extended by a slider unit 80 connected to the dampening/positioning device 70 and the gripper head 20, and/or tilted or pivoted using a hinge 65 or other mechanism connected to the gripper head 20 and the cross arm structure 40.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed:

1. A vertical pipe handling system comprising:

a vertical pipe handler housed between a drill floor and a drill floor support structure;

the vertical pipe handler including:

a pair of telescopic arm structures moveable in a horizontal plane between a retracted position and an extended position;

a cross arm structure located toward a forward end of the pair of telescopic arm structures and spanning between the pair of telescopic arm structures; and wherein a distance between said cross arm structure and said drill floor support structure is minimized when said pair of telescopic arm structures are in said retracted position;

wherein a distance between said cross arm structure and said drill floor support structure is maximized when said pair of telescopic arm structures are in said extended position;

a gripper head connected to the cross arm structure and moveable between a vertical pipe receiving position and a vertical pipe gripping position; wherein said gripper head is below said cross arm structure, and a hinge above said gripper head to change an angular orientation of the gripper head between a first angle and a second angle relative to the cross arm structure.

2. A vertical pipe handling system according to claim 1 wherein the first angle positions the gripper head forward of the cross arm structure and the second angle positions the gripper head rearward of the cross arm structure.

3. A vertical pipe handling system according to claim 1 further comprising means to change a vertical position of the gripper head between a first height and a second height relative to the cross arm structure.

4. A vertical pipe handling system according to claim 3 wherein the means to change the vertical position includes a linearly actuated cylinder.

5. A vertical pipe handling system according to claim 1 further comprising the gripper head including a set of jaws positionable between a first diameter size and a second diameter size.

6. A vertical pipe handling system according to claim 1 wherein the vertical pipe handler is arranged as a mousehole.

7. A vertical pipe handler comprising:

a pair of telescopic arm structures moveable in a horizontal direction between a retracted position and an extended position;

a cross arm structure located toward a forward end of the pair of telescopic arm structures and spanning between the pair of telescopic arm structures; and a gripper head connected to the cross arm structure and moveable between a vertical pipe receiving position and a vertical pipe gripping position, wherein the vertical pipe handler is housed within a floor support structure;

wherein a distance between said cross arm structure and said floor support structure is minimized when said pair of telescopic arm structures are in said retracted position;

wherein a distance between said cross arm structure and said floor support structure is maximized when said pair of telescopic arm structures are in said extended position; and wherein said gripper head is below said cross arm structure, said vertical pipe handler further comprising a hinge above said gripper head to change an angular orientation of the gripper head between a first angle and a second angle relative to the cross arm structure.

8. A vertical pipe handler according to claim 7 wherein the first angle positions the gripper head forward of the cross arm structure and the second angle positions the gripper head rearward of the cross arm structure.

9. A vertical pipe handler according to claim 7 further comprising means to change a vertical position of the gripper head between a first height and a second height relative to the cross arm structure.

10. A vertical pipe handler according to claim 9 wherein the means to change the vertical position includes a linearly actuated cylinder.

11. A vertical pipe handler according to claim 7 further comprising the gripper head including a set of jaws positionable between a first diameter size and a second diameter size.

12. A vertical pipe handler according to claim 7 further comprising means to change the horizontal position of the gripper head between a first horizontal position and a second horizontal position.

13. A vertical pipe handling according to claim 12 wherein the means to change the horizontal position of the gripper head is a slider unit connected to the means to change the vertical position of the gripper head and the gripper head.

14. A method of vertical pipe handling including use of a vertical pipe handler housed within a floor support structure, the method comprising:

actuating a gripper head connected to a cross arm structure of the vertical pipe handler to hold a vertically oriented stand of two or more tubulars;

actuating a pair of telescopic arm structures connected to the cross arm structure of the vertical pipe handler to move the held vertically oriented stand horizontally between a first retracted position that is a first distance from the floor support structure and a second extended position that is a second greater distance from the floor support structure;

providing a hinge above the gripper head; and changing an angular orientation of the gripper head between a first angle and a second angle relative to the cross arm structure.

15. A method according to claim 14 comprising moving the gripper head between a first vertical position and a second vertical position.

16. A method according to claim 14 comprising moving the gripper head between a first horizontal position and a second horizontal position.

17. A method according to claim 14 further comprising moving the gripper head between a position forward and rearward of the cross arm structure.

18. A method according to claim 14 wherein the vertical pipe handler is arranged as a mousehole.

* * * * *